US006104897A

United States Patent [19]

Ishizawa

[11] Patent Number: 6,104,897

[45] Date of Patent: Aug. 15, 2000

[54] IMAGE FORMING APPARATUS

[75] Inventor: Akira Ishizawa, Tokyo, Japan

[73] Assignee: Copyer Co., Ltd., Tokyo, Japan

[21] Appl. No.: 09/341,456

[22] PCT Filed: Jan. 13, 1998

[86] PCT No.: PCT/JP98/00083

§ 371 Date: Sep. 9, 1999

§ 102(e) Date: Sep. 9, 1999

[87] PCT Pub. No.: WO98/30938

PCT Pub. Date: Jul. 16, 1998

[30] Foreign Application Priority Data

Jan. 13, 1997 [JP] Japan ..... 9-4170

[51] Int. Cl.[7] ..... G03G 21/10; G03G 15/06

[52] U.S. Cl. ..... 399/119; 399/113

[58] Field of Search ..... 399/119, 113, 399/111, 120

[56] References Cited

U.S. PATENT DOCUMENTS

| | | | |
|---|---|---|---|
| 5,752,137 | 5/1998 | Haneda | 399/223 |
| 5,758,232 | 5/1998 | Ikunami | 399/111 |
| 5,802,426 | 9/1998 | Miyazaki et al. | 399/113 |
| 5,987,279 | 11/1999 | Ebata | 399/113 |

FOREIGN PATENT DOCUMENTS

| | | |
|---|---|---|
| 61-103175 | 5/1986 | Japan . |
| 9-297443 | 11/1997 | Japan . |

*Primary Examiner*—Richard Moses
*Attorney, Agent, or Firm*—Dellett and Walters

[57] ABSTRACT

When a development unit 30 once taken out from a copying machine 10 is incorporated therein, a developing pressure pin 30*a* engages with a stop face 106*c* of a pressure arm 106 to stop the development unit 30. This can prevent the development unit 30 from colliding against a photosensitive drum 56 when the development unit 30 is incorporated into a body of the copying machine 10.

4 Claims, 12 Drawing Sheets

IMAGE FORMING APPARATUS

TECHNICAL FIELD

The present invention relates to an image formation apparatus which forms an electrostatic latent image on an image-holding member rotating in a prescribed direction, develops the electrostatic latent image with a developing agent, and transfers the image to a transfer-receiving medium.

BACKGROUND TECHNIQUE

Electrophotography type of image formation apparatuses have been widely used hitherto. For example, the electrophotographic image formation apparatus has a document table made of glass for placing a source document; and forms a printed picture image (copied picture image) through the steps of projecting illumination light upward to the source document placed on the document table, electrifying uniformly a drum-shaped image-holding member (photosensitive drum) with rotation at a prescribed process speed, projecting the light carrying the image information onto the photosensitive drum to form electrostatic latent image, developing the electrostatic latent image by use of a development unit to form a developed image, and transferring the developed image onto a recording medium to obtain a printed image (copied image).

In one type of image formation apparatus, a photosensitive drum and a development unit are placed with a prescribed spacing (e.g., 0.3 mm) and a developing agent is supplied from the development unit to the photosensitive drum to develop an electrostatic latent image. This development unit is usually incorporated demountably into the body of the image formation apparatus.

In the image formation apparatus having such a construction, the development unit is demounted from the main body of the apparatus for replenishment of the developing agent, and is incorporated again into the main body after the replenishment. In the operation of incorporation of the development unit, if the development unit is pushed into the main body vigorously, the development unit can collide against the photosensitive drum regardless of the designed spacing (aforementioned prescribed spacing) between the development unit and the photosensitive drum. The collision of the development unit against the photosensitive drum may impair the photosensitive drum and the development unit to hinder the image formation.

DISCLOSURE OF THE INVENTION

The present invention intends, under the aforementioned circumstances, to provide an image formation apparatus in which the development unit can be incorporated into the main body of the apparatus without causing collision of the development unit against the photosensitive drum.

The image formation apparatus of the present invention comprises an image-holding member rotating in a prescribed direction for forming an electrostatic latent image thereon; and a development unit having a development sleeve rotating at a prescribed position apart with a prescribed spacing from the image-holding member, and being demountably incorporated into the apparatus body; and developing the electrostatic latent image formed on the image-holding member and transferring the developed image onto an image-receiving medium, the image formation apparatus having (1) a development lever which is turnable in the predetermined direction when pushed in a direction perpendicular approximately to the direction of incorporating and demounting the development unit, (2) a stopping member which stops, during operation of incorporation of the development unit into the apparatus body, once the development sleeve apart from the image-holding member before the prescribed position, and then allows the once stopped development sleeve to move to the aforementioned prescribed position by pushing the aforementioned development lever in the above perpendicular direction and turning the development lever by a prescribed angle.

The image formation apparatus may be provided with (3) a development lever shaft having the development lever and the stopping member fixed thereto and turning together with the development lever and the stopping member, (4) a supporting plate which supports the development lever shaft and has two grooves with interposition of a ridge, and (5) a protrusion which is made to fit to one of the above two grooves by pushing the aforementioned development lever in the above perpendicular direction and turning the development lever by a prescribed angle; and (6) the development sleeve may be placed at the predetermined position when the protrusion is fitted to one of the two grooves, and be placed at the position distant from the image-holding member when the protrusion is fitted to the other one of the two grooves.

The image formation member may be provided with (7) a door which covers the development unit and is openable only when the stopping member is turned by the aforementioned prescribed angle to bring the development sleeve to the prescribed position, and (8) a hook which catches the door only when the door is closed.

BEST MODE FOR PRACTICING THE INVENTION

An embodiment of the image formation apparatus of the present invention is explained below by reference to drawings.

Figure 1:
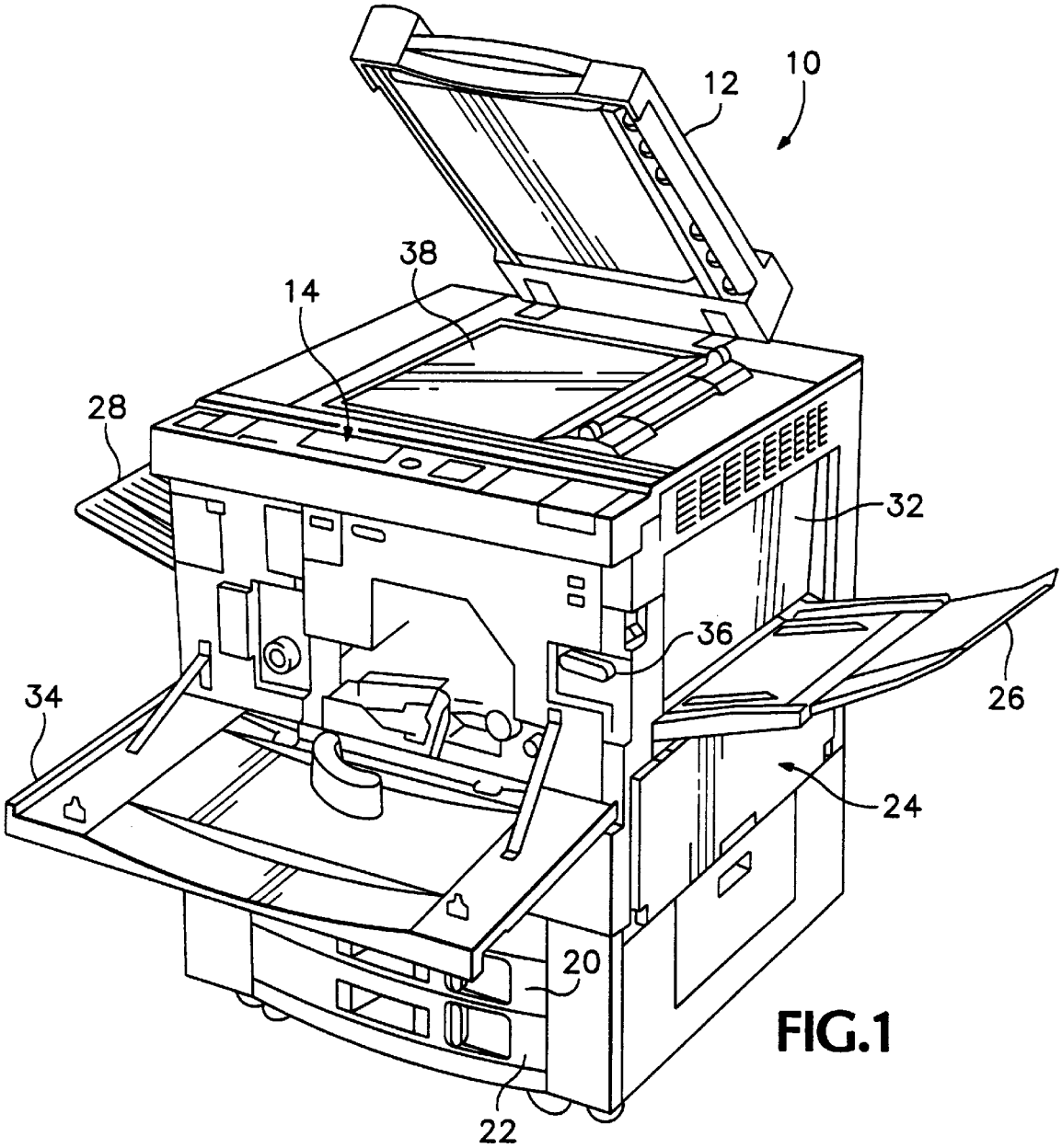
FIG. 1 is a perspective view of a copying machine of an embodiment of the image formation apparatus of the present invention.

FIG. 1 is a perspective view showing external appearance of a copying machine of an embodiment of the present invention.

On the top face of copying machine 10 (an example of the image formation apparatus in the present invention), there is placed an openable document table cover 12. The document table cover 12 also serves as a document feeder (DF) for feeding a source document to the document table. At the front side of the top face, operation panel 14 is provided for inputting the number of reproduced copies, and so forth. This copying machine 10 is capable of forming an image selectively either on a cut paper sheet or on paper roll. This copying machine 10 has four cassettes 16, 18, 20, 22 (cassettes 16, 18 are not shown in FIG. 1) which store respectively cut paper sheets and are demountable from the main body of copying machine 10. The copying machine 10 has roll paper unit 24 which is demountable from copying machine 10. Further, copying machine 10 has manual feed tray 26 for feeding a smaller size of recording paper such as a post card, and discharged-paper tray 28 for holding recording paper sheets after image formation. Toner replenishment door 32 (an example of the door in the present invention) is provided above manual feed tray 26. This toner replenishment door is opened for demounting or incorporating a development unit 30 (see FIG. 2). Front door 34 which is openable is provided above cassettes 16, 18, 20, 22. Development lever 36 mentioned later can be seen when front door 34 is opened.

The process for formation of an image with copying machine 10 of FIG. 1 is explained below by reference to FIG. 2.

Figure 2:
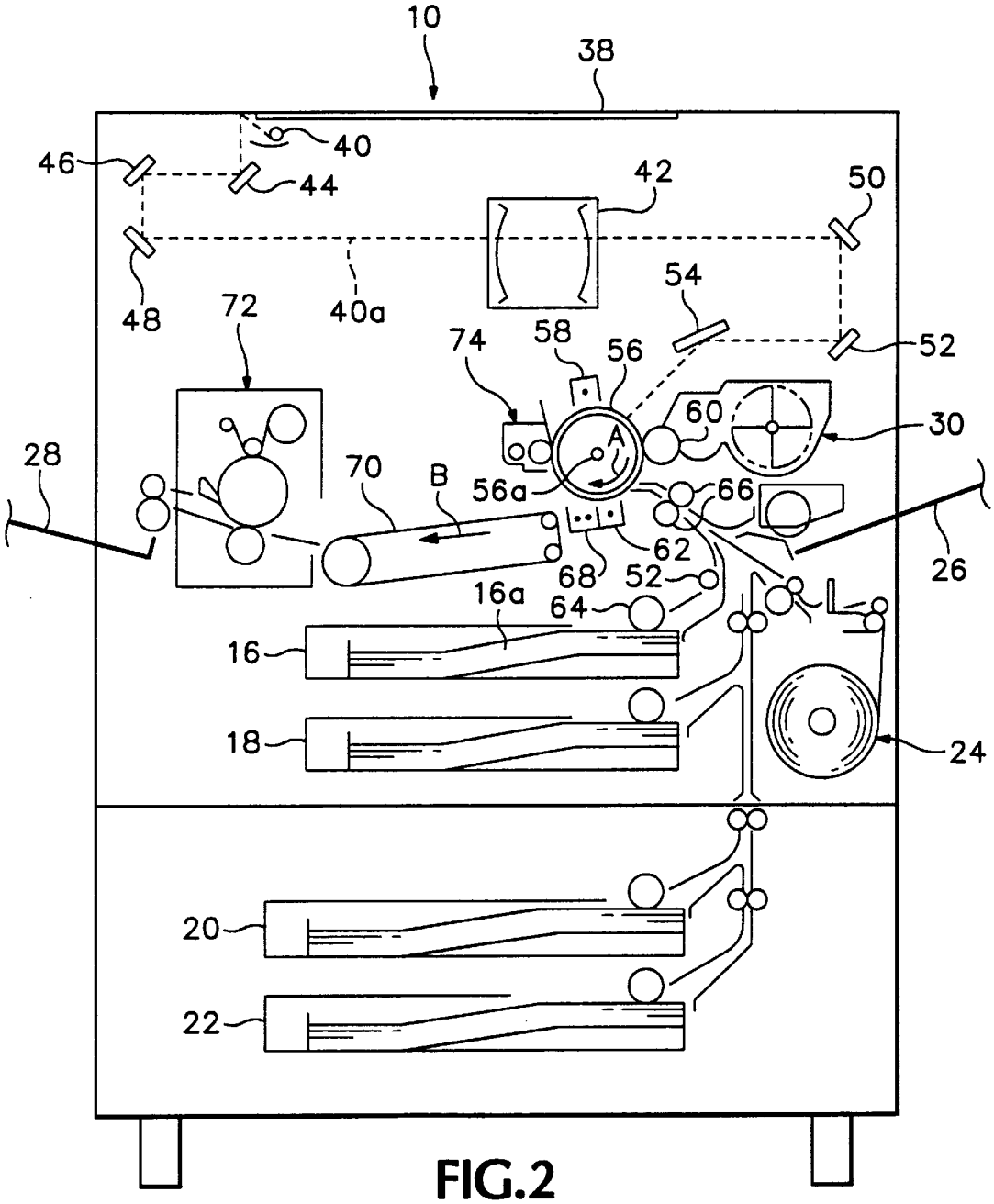
FIG. 2 is a schematic drawing illustrating the internal structure of the copying machine shown in FIG. 1.

FIG. 2 is a schematic drawing showing roughly the internal structure of copying machine 10.

Document-supporting glass plate 38 is placed under document table cover 12 (see FIG. 1). A light-exposure optical system is provided below document-supporting glass plate 38 to illuminate the source document to obtain signal carrying image information. This light-exposure optical system includes light source 40, lens 42, and mirrors 44, 46, 48, 50, 52, 54. A source document placed on document-supporting glass plate 38 is exposed to light from light source 40, and reflected light 40*a* from the source document is projected as image signals through lens 42, and mirrors 44, 46, 48, 50, 52, 54 to photosensitive drum 56 placed below the light-exposure optical system.

Photosensitive drum 56 has a rotation shaft 56*a* in the direction vertical to the drawing paper face of FIG. 2, rotating in the direction shown by an arrow A. Primary electrifier 58 is provided on the upstream side, in the rotation direction, of photosensitive drum 56 from the position of projection of light reflected by the source document to electrify uniformly photosensitive drum 56. After photosensitive drum 56 is electrified uniformly by primary electrifier 58 to form an electrified face, an electrostatic latent image is formed by illumination of reflected light 40*a* from the source document.

Development unit 30 is provided on the downstream side of the above illumination position in the rotation direction of photosensitive drum 56 to develop the electrostatic latent image. Development unit 30 has development sleeve 60 which rotates with a prescribed spacing to photosensitive drum 56 and supplies a developing agent (toner) to photosensitive drum 56. The region where development sleeve 60 and photosensitive drum 56 are counterposed is the development region for developing the electrostatic latent image. On arrival of the electrostatic latent image at the development region with rotation of photosensitive drum 56, the electrostatic latent image is developed by development unit 30 to form a toner image (developed image).

Transfer electrifier 62 is provided on the downstream side of the development region in the rotation direction of photosensitive drum 56 to transfer the toner image onto a recording paper. The region where photosensitive drum 56 and transfer electrifier 62 are counterposed is a transfer region for transferring the toner image onto the recording paper sheet. On arrival of the toner image at the transfer region by rotation of photosensitive drum 56, the toner image is transferred onto the recording paper sheet delivered to the transfer region.

The recording paper is delivered from cassette 16, 18, 20, 22 or roll paper unit 24 to the transfer region. For delivery of the recording paper to the transfer region, for example, a cut paper sheet 16*a* is sent out from cassette 16 by paper feed roller 64, and the front end of cut paper sheet 16*a* is kept waiting in contact with registration rollers 54*a*, 54*b* to form a loop. The recording paper sheet is delivered to meet the timing when the toner image on photosensitive drum 56 reaches the transfer region.

The recording paper sheet having received the transferred toner image is separated by separation electrifier 68 from photosensitive drum 56, and is delivered by delivery belt 70 rotating in the arrow-B direction to fixation device 72. By this fixation device 72, the toner image is fixed on the recording paper sheet. After the toner image fixation, the recording paper sheet is discharged through a paper outlet (not shown in the drawing) onto discharged paper tray 28. The toner remaining on photosensitive drum 56 after the image transfer is removed by cleaning device 74 from photosensitive drum 56. The residual electric charge remaining on photosensitive drum 56 is eliminated by a destaticizing lamp (not shown in the drawing). Thus the photosensitive drum 56 is ready for the next image formation.

The process for demounting the development unit 30 from copying machine 10, replenishing toner, and incorporating development unit 30 into copying machine 10 is explained by reference to FIGS. 3–9.

Figure 3:
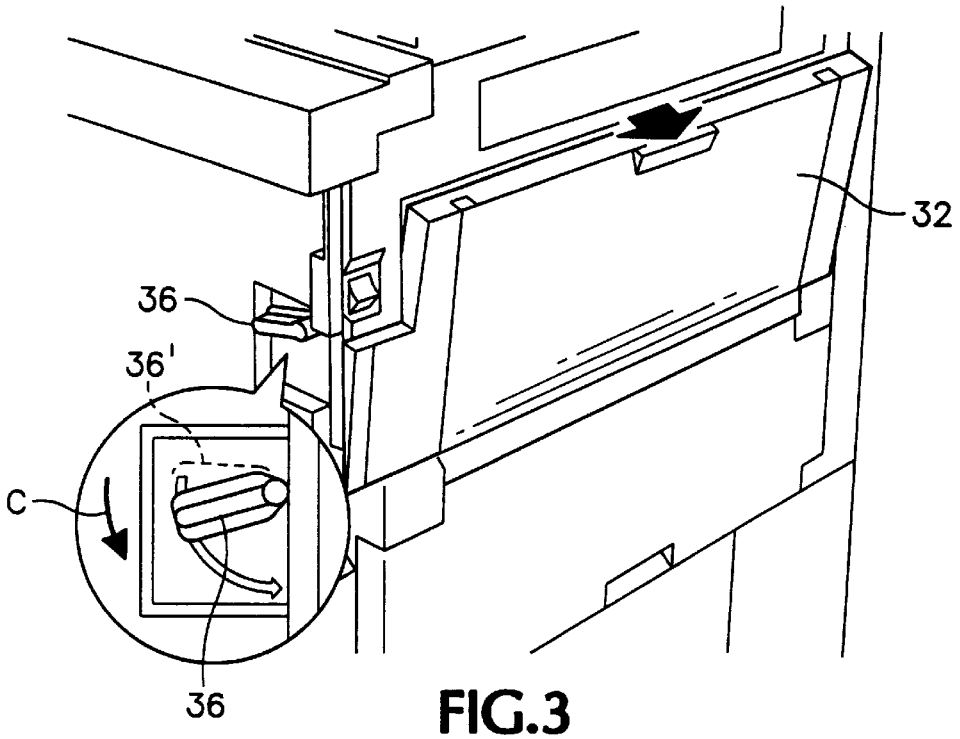
FIG. 3 is a perspective view illustrating a state of a toner-replenishment door opened slightly.
Figure 4:
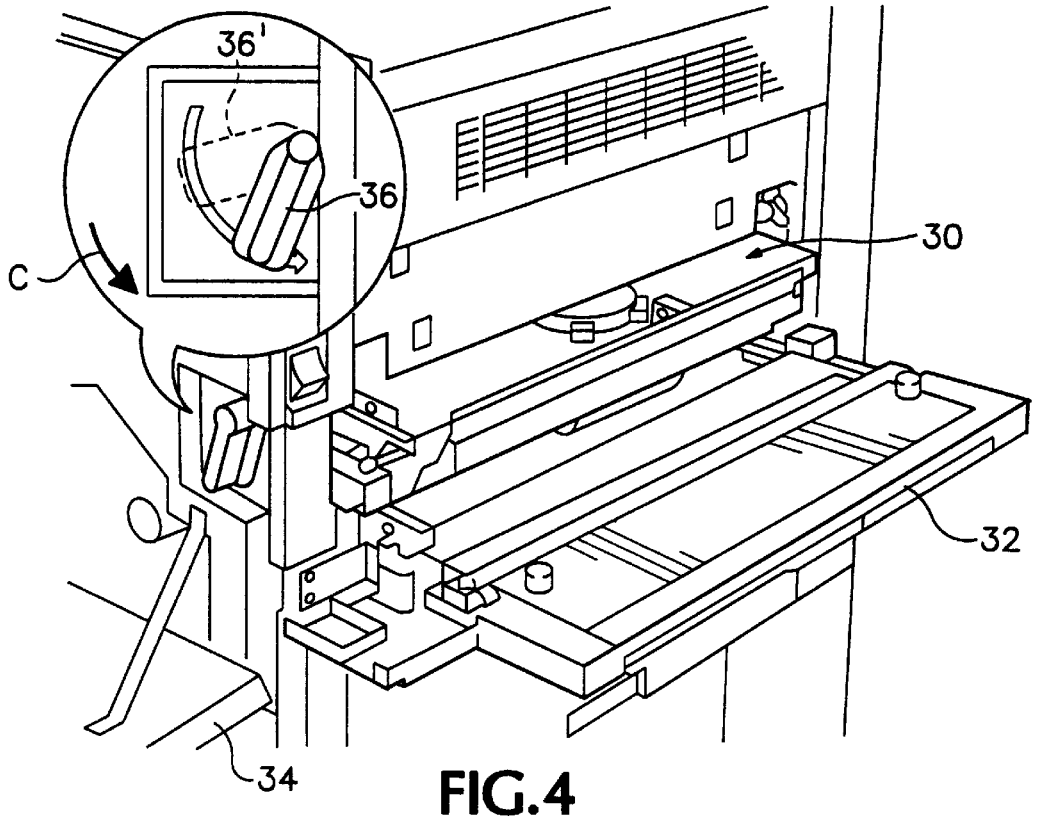
FIG. 4 is a perspective view illustrating the development unit partly drawn out with the toner replenishment door completely opened.
Figure 5:
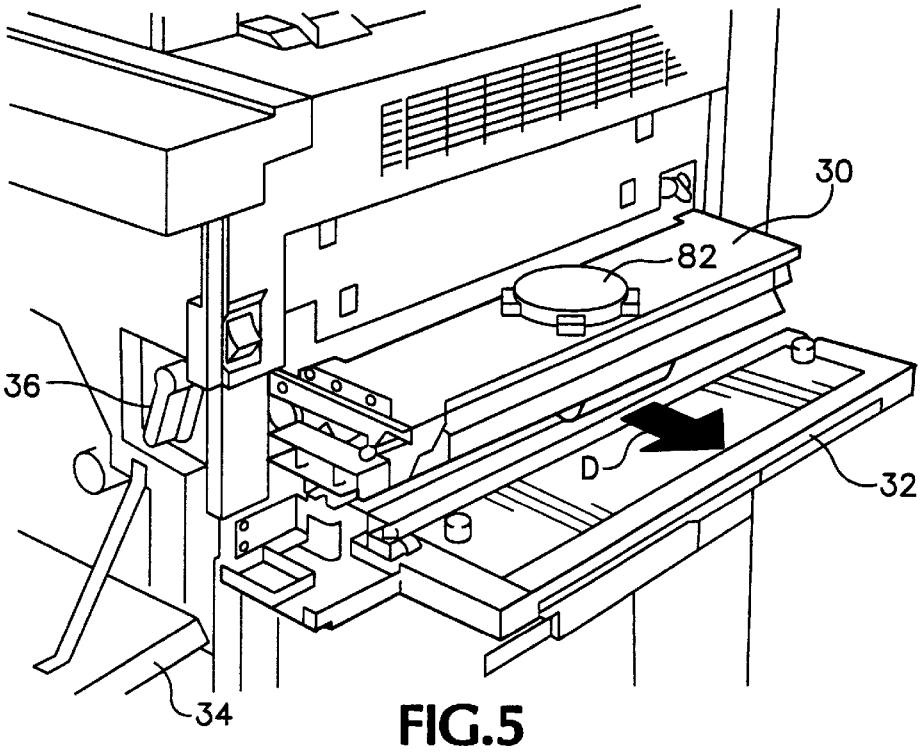
FIG. 5 is a perspective view illustrating a state of the development unit demounted.
Figure 6:
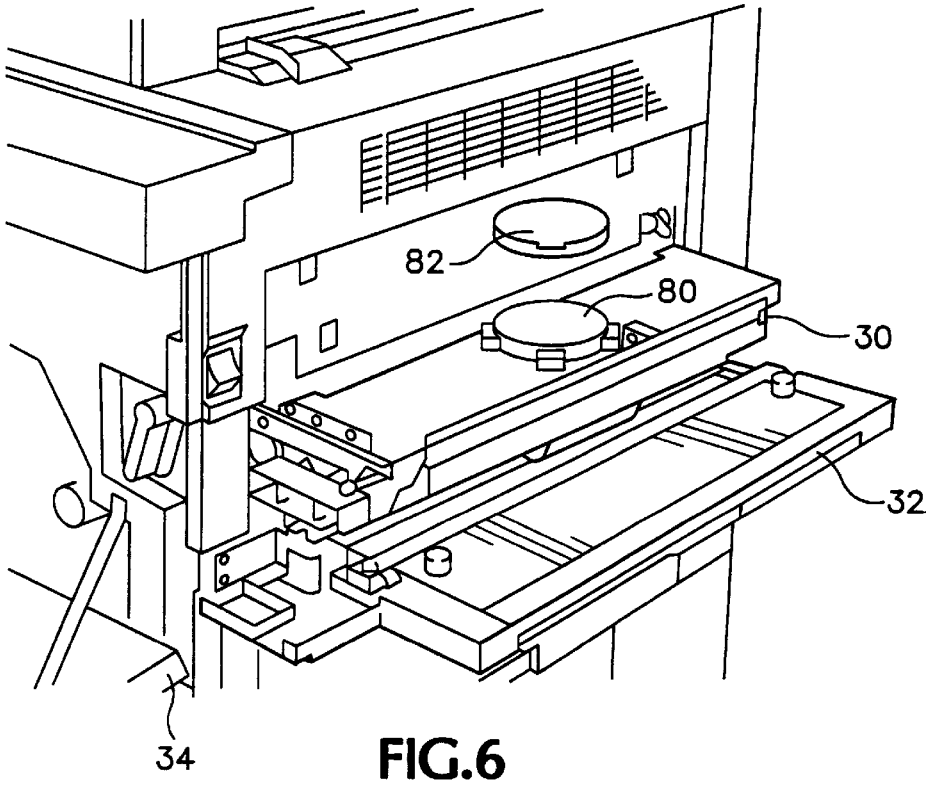
FIG. 6 is a perspective view illustrating a state of the demounted development unit having the toner replenishment hole opened.
Figure 7:
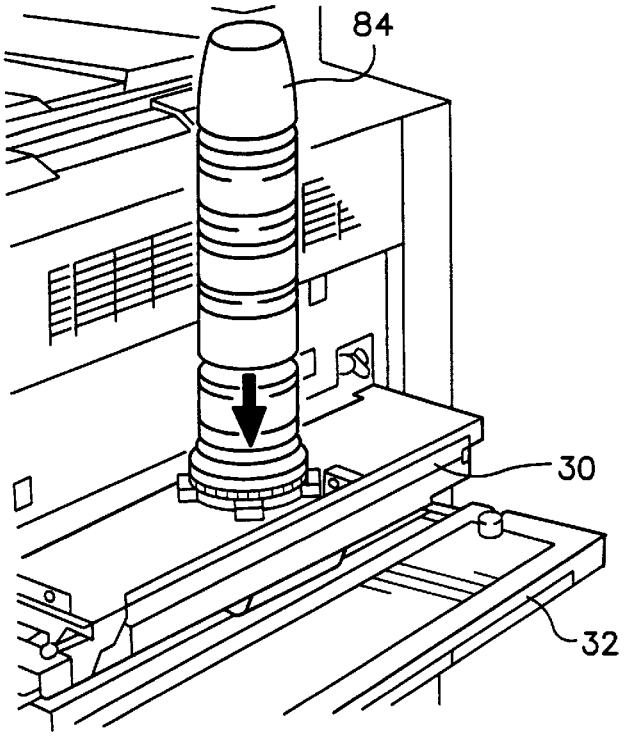
FIG. 7 is a perspective view illustrating the state of replenishing a toner with a toner bottle connected to the toner replenishment hole.
Figure 8:
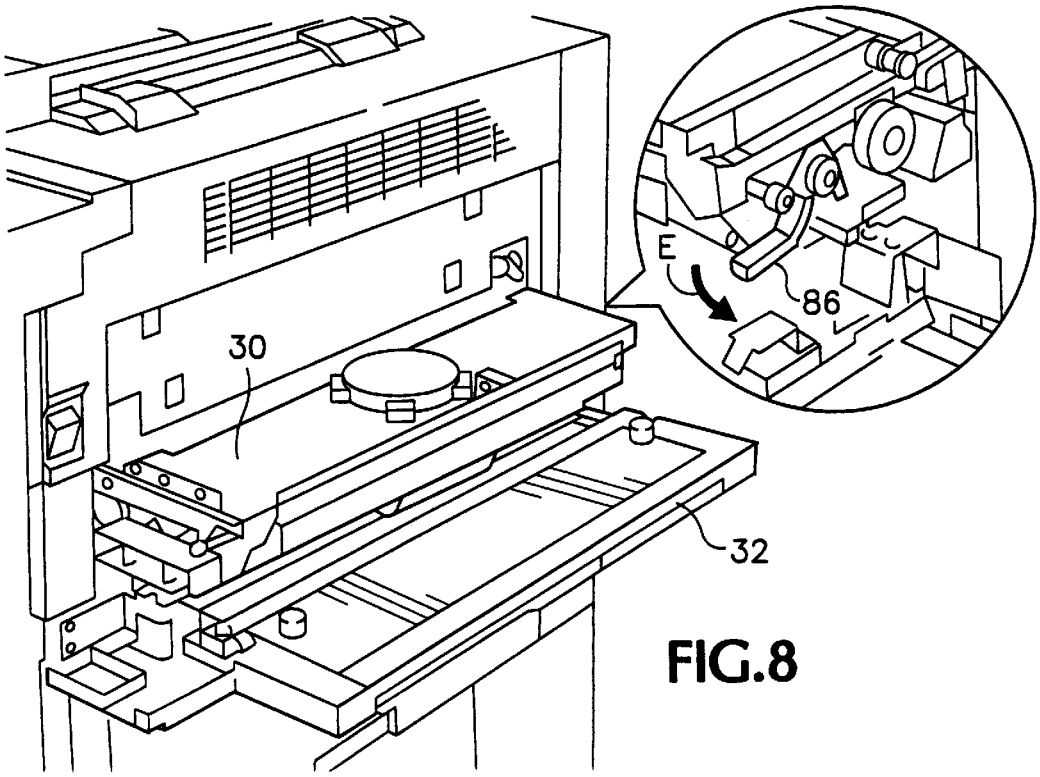
FIG. 8 is an enlarged perspective view of a toner-stirring lever placed at the back side of the development unit.
Figure 9:
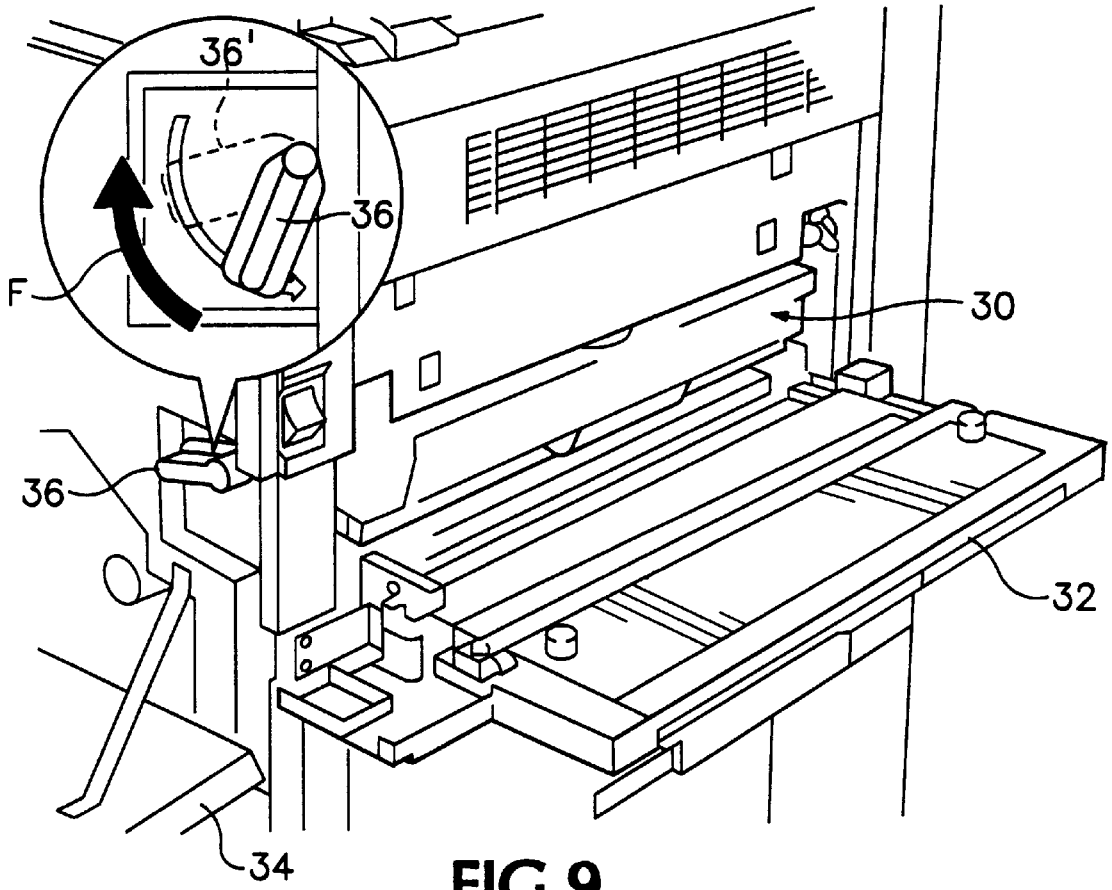
FIG. 9 is a perspective view illustrating the development unit incorporated into the copying machine after toner replenishment.

FIGS. 3–9 illustrate enlargedly toner replenishment door 32 and related parts. FIG. 3 is a perspective view illustrating a toner replenishment door 32 which is slightly opened. FIG. 4 is a perspective view illustrating the development unit 30 partly drawn out with toner replenishment door 32 completely opened. FIG. 5 is a perspective view illustrating development unit 30 demounted. FIG. 6 is a perspective view illustrating development unit 30 demounted with the toner replenishment hole opened. FIG. 7 is a perspective view illustrating a state of replenishing of a toner with a toner bottle connected to the toner replenishment hole. FIG. 8 is a perspective view of a toner-stirring lever placed at the back side of the development unit. FIG. 9 is a perspective view illustrating the development unit 30 having been replenished with a toner and being incorporated into the copying machine 10. In these drawings, the same numerals and symbols are used for the corresponding constituting elements as in FIGS. 1 and 2.

In copying machine 10, toner replenishment door 32 is closed during image formation (see FIG. 1). In this state, development lever 36 is set at pressing position 36' nearly horizontally as shown by a broken line in FIG. 3, and toner replenishment door 32 is locked by hook 100 (see FIG. 10). When toner replenishment door 32 is closed and development lever 36 is fixed to pressing position 36', development sleeve 60 (see FIG. 2) is kept apart at a prescribed spacing from photosensitive drum 56.

To open toner replenishment door 32, development lever 36 is turned in the arrow-C direction to move development lever 36 to the position shown by the full line in FIG. 3. This turning movement releases the lock of toner replenishment door 32 by the hook to open toner replenishment door 32 slightly. The slightly opened toner replenishment door 32 is opened completely by hand, and development lever 36 is further tuned in the arrow-C direction as shown in FIG. 4. By this lever turning to move development lever 36 to the position shown by the full line in FIG. 4, the pressure of development unit 30 to photosensitive drum 56 is released to keep away development sleeve 60 from photosensitive drum 56 with the distance larger than the above prescribed spacing. Thereafter, development unit 30 is drawn out in the arrow-D direction until the development unit 30 is trapped to demount it as shown in FIG. 5.

After development unit 30 is demounted, cap 82 of toner replenishment hole 80 is removed as shown in FIG. 6. Toner bottle 84 is connected to toner replenishment hole 80 to feed a toner to the hopper (not shown in the drawing) in development unit 30 as shown in FIG. 7. In the case where the toner cannot be replenished as desired from the toner bottle 84 owing to accumulation of the toner under toner replenishment hole 80 or other cause, toner bottle 84 is once removed from toner replenishment hole 80 as shown in FIG. 8, and toner stirring lever 86 at the back face of development unit is pushed several times downward (in the arrow-E direction) to rotate a stirring rod (not shown in the drawing) provided rotatably in the hopper. Thereby, toner is stirred to distribute uniformly in the hopper portion. Thereafter, toner bottle 84 is connected again to toner replenishment hole 80 to feed the toner.

After completion of the toner replenishment, development unit 30 is pushed into copying machine 10. Then the pushed development unit 30 is stopped once by the stopping member described later. Simultaneously, development sleeve 60 (see FIG. 2) is also stopped once. This stopping position of development sleeve 60 is apart from photosensitive drum at distance larger than the prescribed spacing (see FIG. 2). The once stopped development sleeve 60 is brought near to photosensitive drum 56 to keep the prescribed spacing by pressing the development lever 36 in the arrow-F direction (reverse to the arrow-C direction) to turn development lever 36 to pressing position 36' (the prescribed position in the present invention) shown by the broken line in FIG. 9. This angle of the turning is an example of the prescribed angle in the present invention. By this turning movement, the once stopped development sleeve 60 is brought near to photosensitive drum 56 at the prescribed spacing, and toner replenishment door 32 can be closed to be ready for development.

An example of the stopping member of the present invention is explained by reference to FIG. 10 and FIG. 11.

Figure 10:
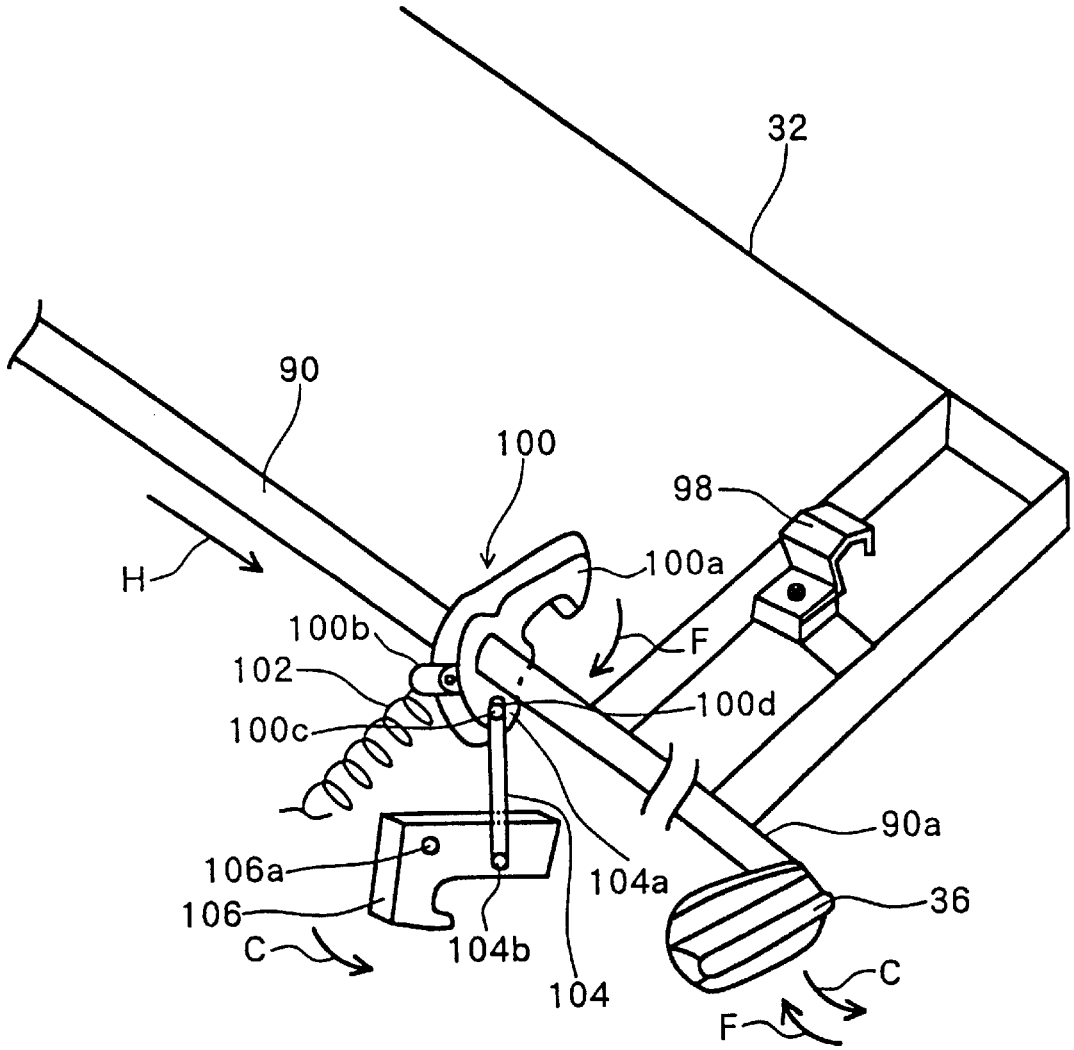
FIG. 10 is perspective view of an example of a stopping member.
Figure 11:
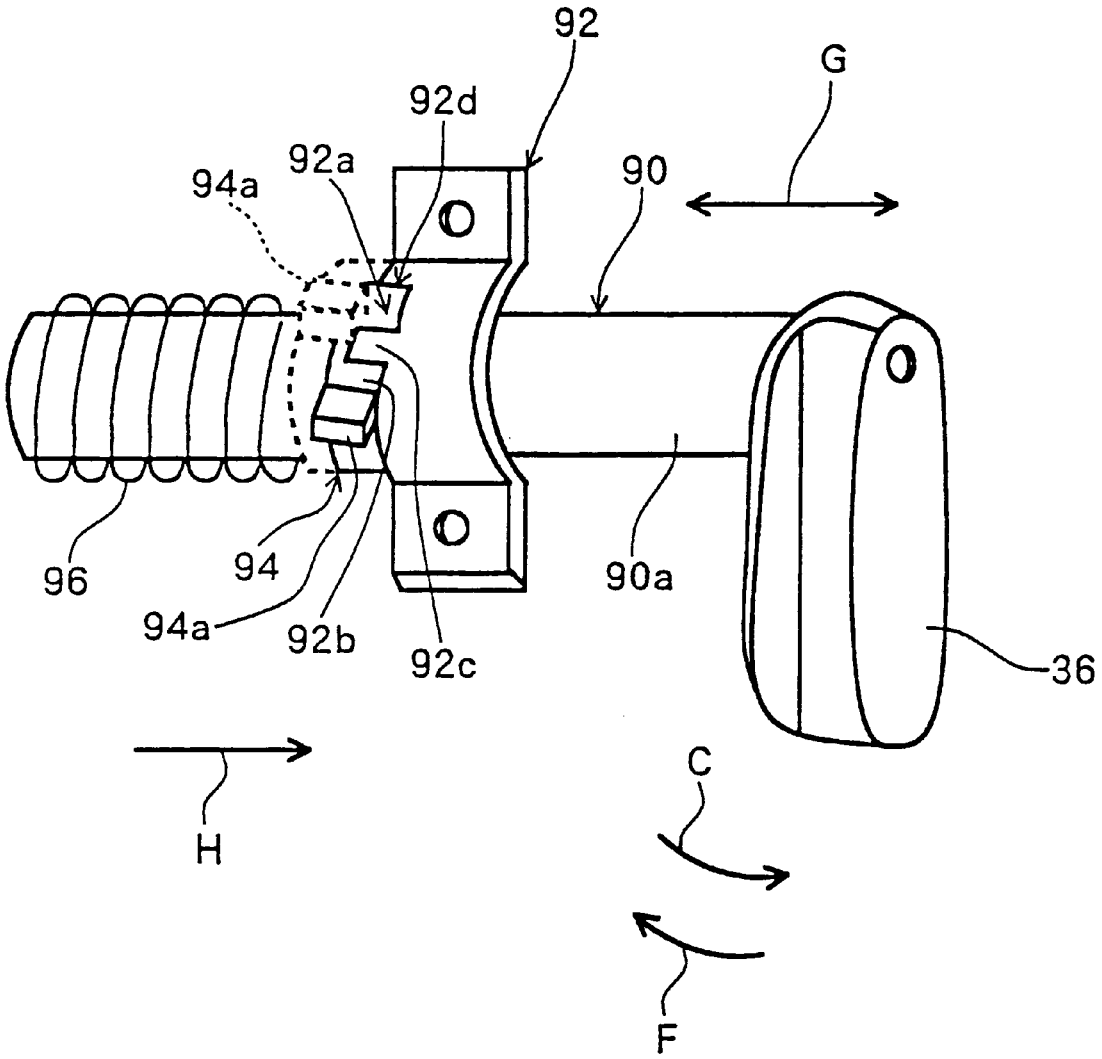
FIG. 11 is a perspective view showing constitution of a development lever and related parts.

FIG. 10 is perspective view of a stopping member. FIG. 11 is a perspective view of a development lever and the related parts. In FIGS. 10 and 11, the same numerals and symbols are used for the corresponding constitutional elements as in FIGS. 3–9.

Development lever 36 is fixed firmly to end portion 90*a* of development lever shaft 90 attached turnably to the main body of copying machine 10. This development lever shaft 90 is arranged perpendicularly to the direction of incorporating and demounting the development unit 30 (see FIG. 1). By turning development lever 36 in the arrow-C or arrow-F direction, development lever shaft 90 is turned also in the arrow-C or arrow-F direction. Near development lever 36 in the main body of copying machine 10, supporting plate 92 in a shape of a letter "C" is fixed for supporting development lever shaft 90 turnably, and movably in the arrow-G direction. This supporting plate 92 has two grooves 92*a*, 92*b* in periphery direction, the two grooves being separated by ridge 92*c*.

Stopper 94 is fixed on development lever shaft 90 at the portion adjacent to the supporting plate 92. This stopper 94 has protrusion 94*a*. Protrusion 94*a* of stopper 94 can be moved by turning of development lever 36 in the arrow-C or arrow-F direction to turn development lever shaft 90. On development lever shaft 90, compression coil spring 96 is wound in the portion opposite to development lever 36 relative to stopper 94. One end of compression coil spring 96 (not shown in the drawing) is fixed to front side plate of the main body of copying machine 10, and the other end thereof is brought into contact with stopper 94. Stopper 94 is energized incessantly by compression coil spring 96 in the arrow-H direction, whereby development lever shaft 90 is also energized incessantly in the arrow-H direction. In this embodiment, supporting plate 92 and stopper 94 constitute an example of turn-regulating member of the present invention.

When protrusion 94*a* of stopper 94 is engaged with groove 92*a* of supporting plate 92, for example, protrusion 94*a* is disengaged from groove 92*a* by pushing development lever 36 in the direction opposite to the arrow-H and simultaneously turning development lever 36 in the arrow-C direction. Protrusion 94*a* is allowed to fit to groove 92*b* by turning further development lever 36 in arrow-C direction and releasing development lever 36 owing to the force of compression coil spring 96. The position of lever 36 with protrusion 94*a* fitting to groove 92*a* is the pressing position 36' (the prescribed position in present invention) shown by dotted line in FIG. 9. On the other hand, the position of development lever 36 with protrusion 94*a* fitting to groove 92*b* is shown by the full line in FIG. 4.

Development lever shaft 90 has hook 100 fixed thereto at the inner part from the front side plate of the main body to lock latch arm 98 of tone replenishment door 32 as shown in FIG. 10. This hook 100 is turned with turning movement of development lever shaft 90. Tip portion 100*a* of hook 100 in a shape of a key catches latch arm 98.

Middle portion 100*b* of hook 100 is connected to the end of pulling coil spring 102. This pulling coil spring 102 energizes hook 100 together with development lever shaft 90 to turn in the arrow-F direction. Therefore, development lever 36 is also energized to turn in the arrow-F direction by pulling coil spring 102. However, when protrusion 94*a* of stopper 94 is fitted to groove 92*b,* development lever 36 is prevented from turning in the arrow-F direction because protrusion 94 is caught by ridge 92*c* of supporting plate 92. Development lever 36 can be turned in the arrow-F direction by pushing development lever 36 in the direction opposite to the arrow-H direction to allow protrusion 94*a* to escape from groove 92*b.*

Hook 100 has slot 100*d* at the bottom end 100*c* thereof. To this slot 100*d,* one end 104*a* of connecting arm 104 is linked movably. The other end 104*b* of connecting arm 104 is linked to pressing arm 106 turnably around central shaft 106*a*. Thereby, with turning of hook 100 in the arrow-F direction, pressing arm 106 turns around central shaft 106*a* in the arrow-F direction.

The movements of development lever 36, pressing arm 106, and related parts during the demounting and incorporation of development unit 30 are explained below by reference to FIGS. 12–15.

Figure 12:
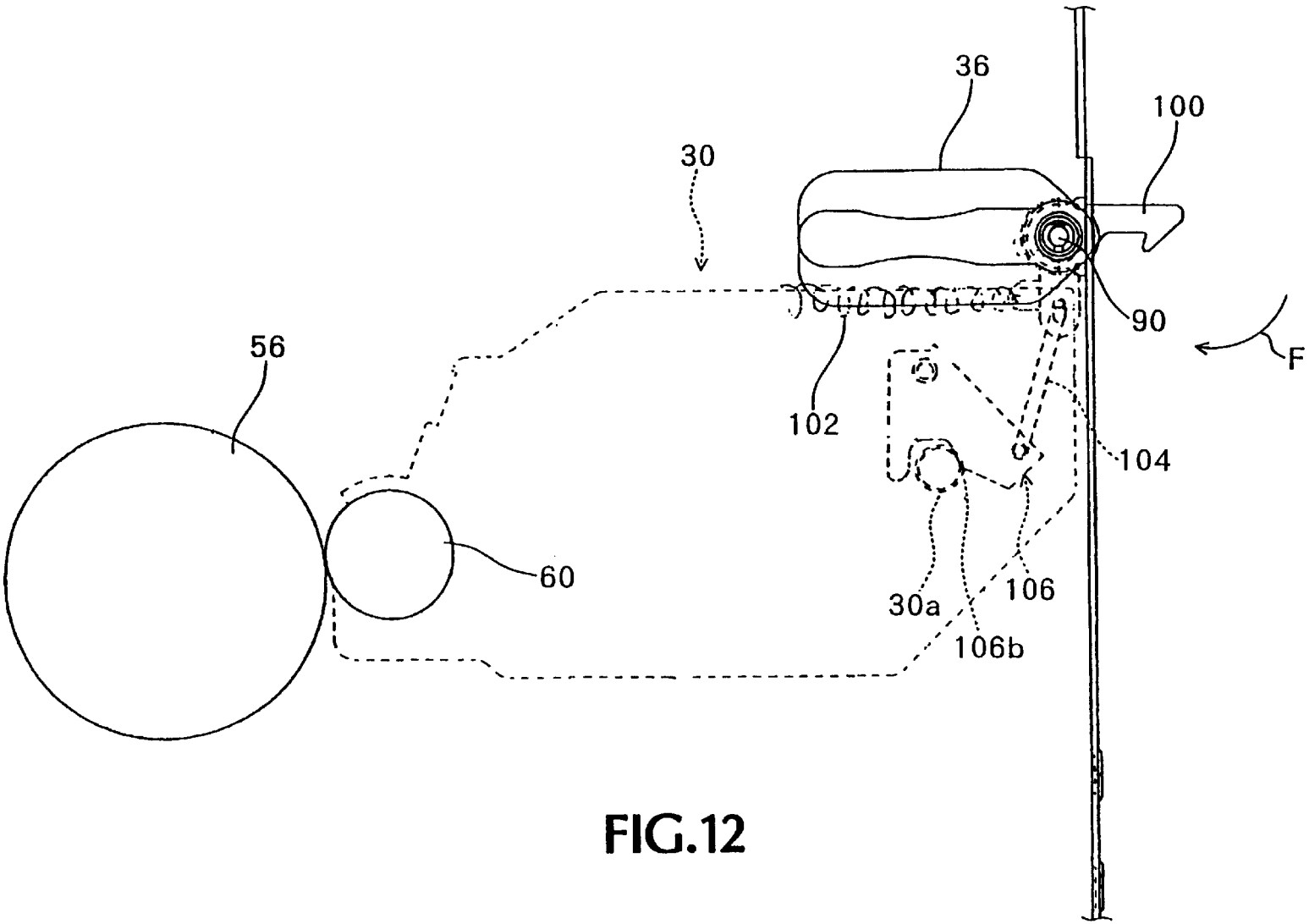
FIG. 12 is a schematic drawing illustrating a state of a toner replenishment door closed completely and a development sleeve brought near to a photosensitive drum with a prescribed spacing.
Figure 13:
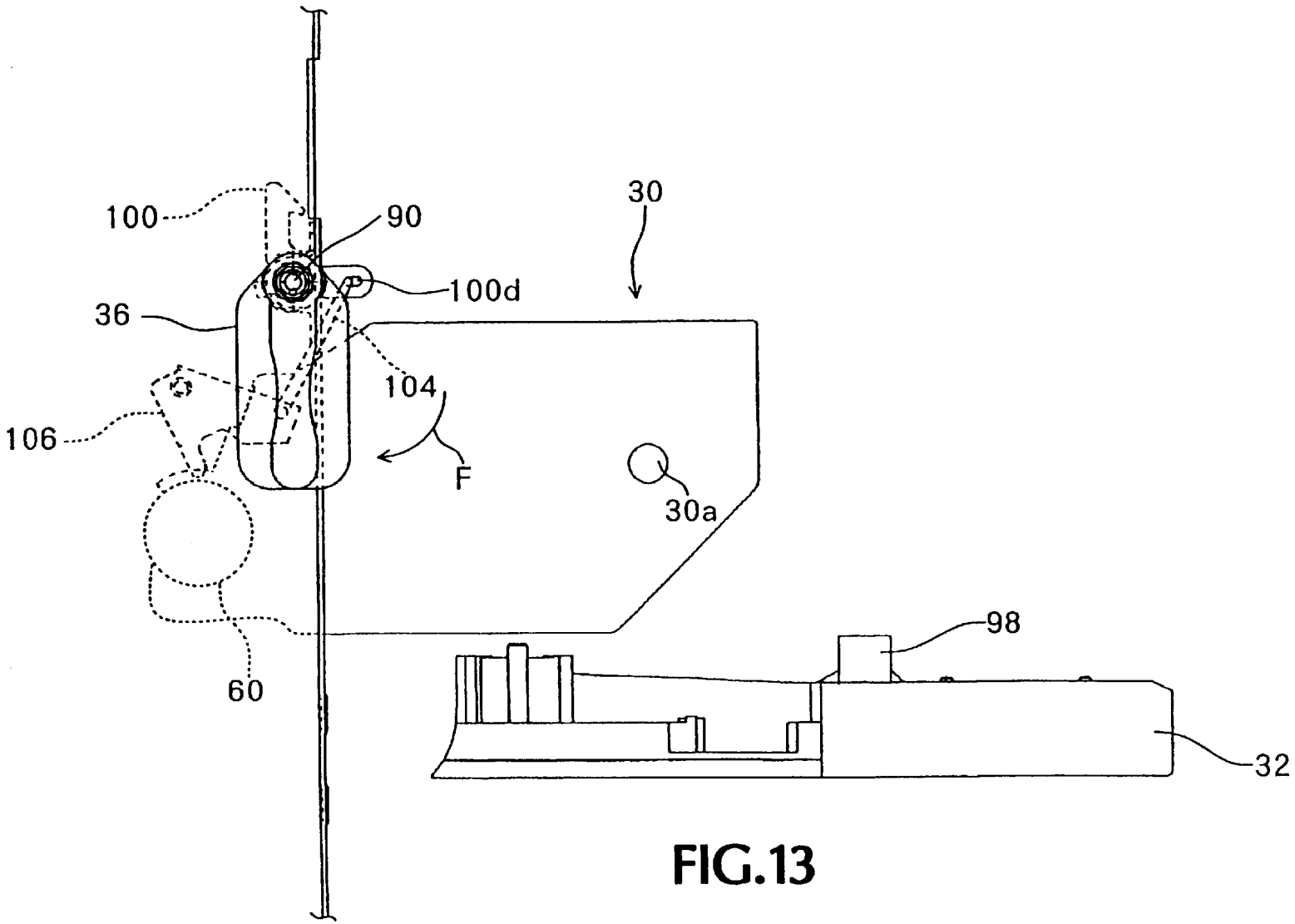
FIG. 13 is a schematic drawing illustrating a state of a development unit demounted.
Figure 14:
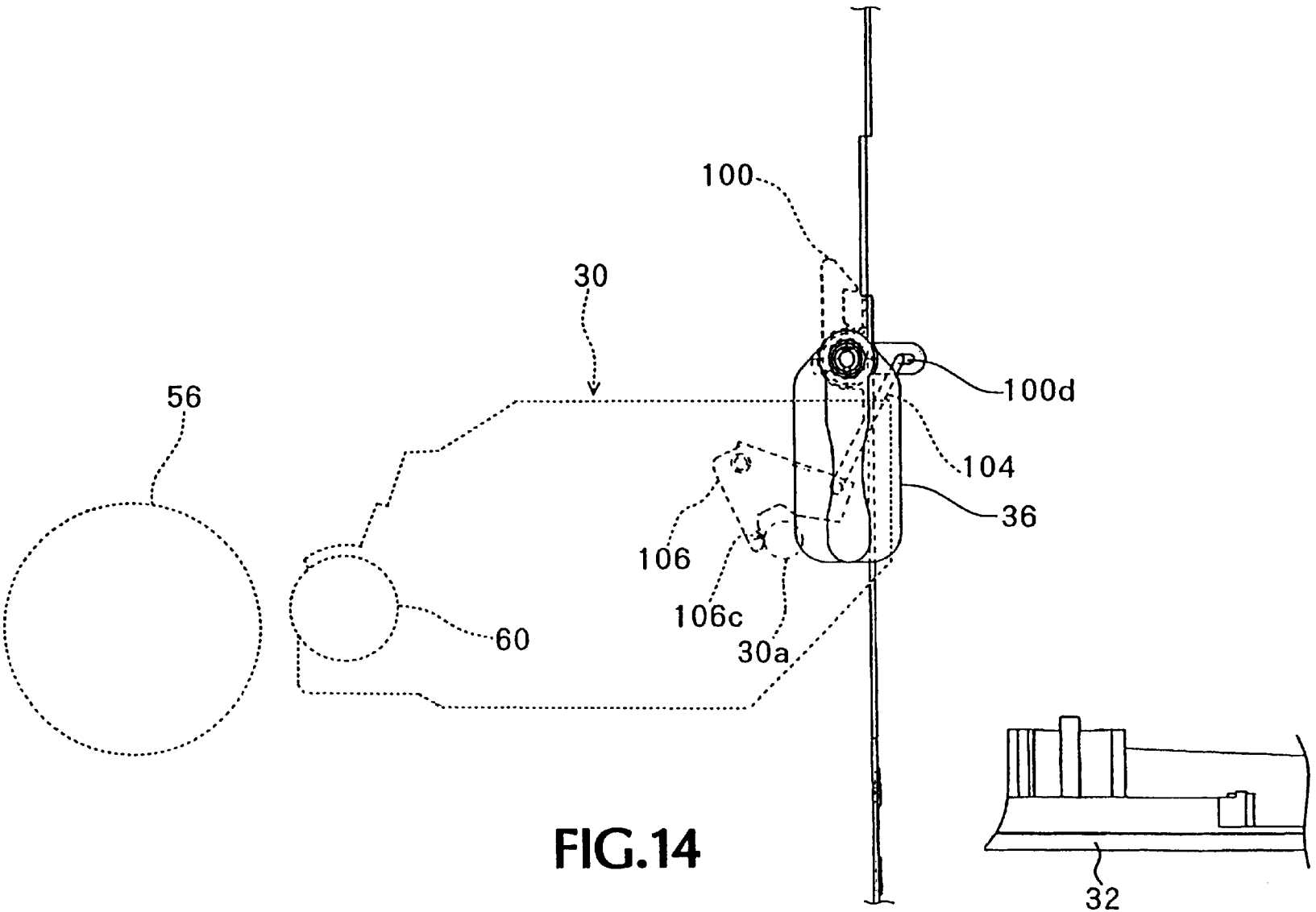
FIG. 14 is a schematic drawing illustrating a state of a development unit stopped once when the development unit is pushed for incorporation.
Figure 15:
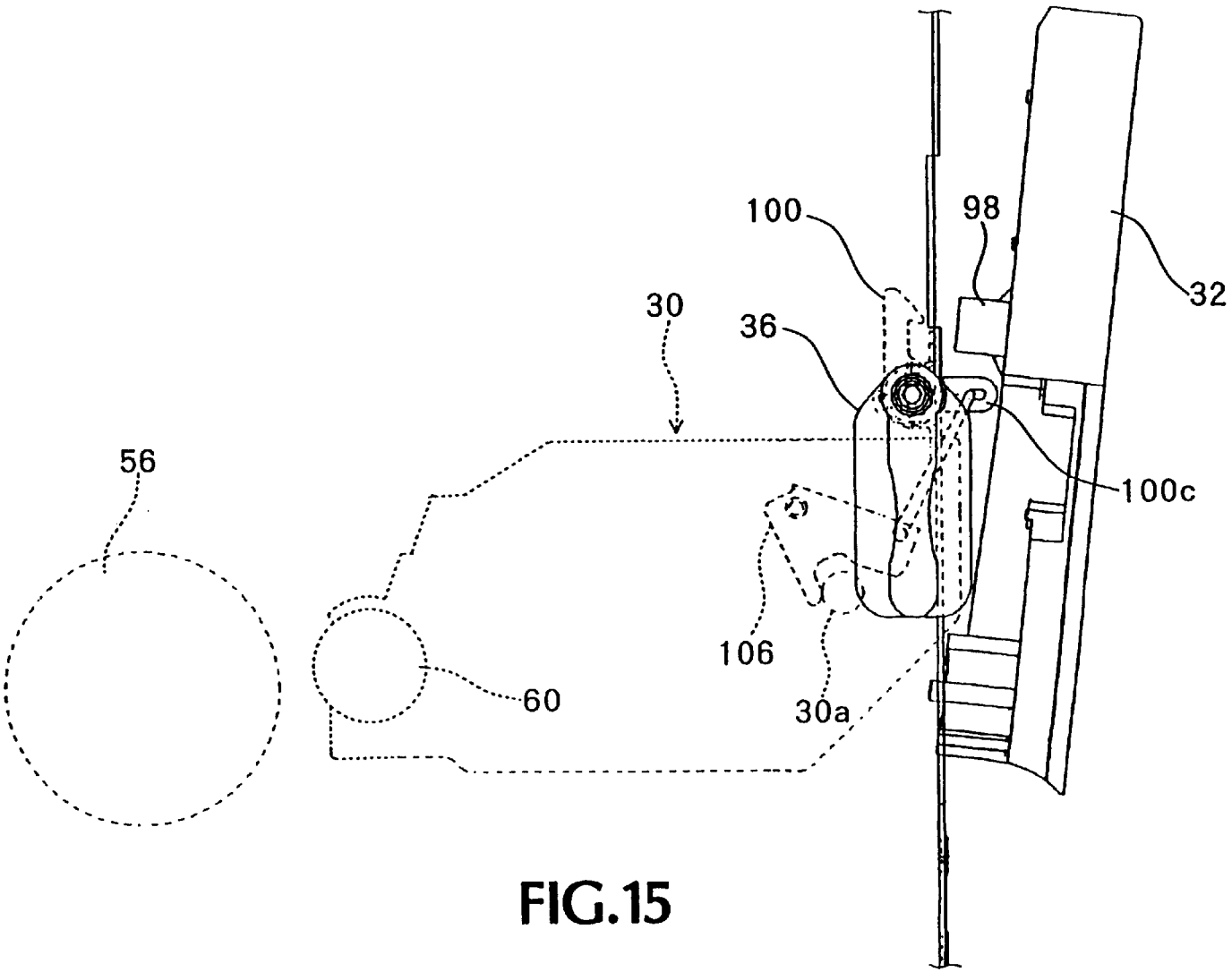
FIG. 15 is a schematic drawing illustrating a state of a toner replenishment door being closed not completely when the development unit is once stopped before a development sleeve is brought near to a photosensitive drum at a prescribed distance.

FIG. 12 is a schematic drawing illustrating a state of a toner replenishment door closed completely and a development sleeve brought near to a photosensitive drum with a prescribed spacing. FIG. 13 is a schematic drawing illustrating a state of a development unit demounted. FIG. 14 is a schematic drawing illustrating a state of a development unit stopped once while the development unit is pushed for incorporation. FIG. 15 is a schematic drawing illustrating a state of a toner replenishment door being closed not completely when the development unit is once stopped and a development sleeve is not brought near to a photosensitive drum with a prescribed spacing. In these drawings, the same numerals and symbols are used for the corresponding constructing elements as in FIGS. 3–11.

In FIG. 12, toner replenishment door 32 (not shown in FIG. 12) is closed completely and development sleeve 60 is brought near to photosensitive drum 56 with a prescribed spacing. In this state, development lever 36 takes a nearly horizontal pressing position, and hook 100 locks latch arm 98 (see FIG. 10) of toner replenishment door 32 to close toner replenishing door 32. In this state, development-pressing pin 30*a* provided on the side wall of development unit 30 is pushed by pressing face 106*b* of pressing arm 106, whereby development sleeve 60 is brought near to photosensitive drum 56 with a prescribed spacing. Thus, protrusion 94*a* of stopper 94 shown in FIG. 11 is fit to groove 92*a* of supporting plate 92 to be in contact with groove end portion 92*d,* and hook 100 and development lever 36 are energized by pulling coil spring 102 to turn around development lever shaft 90 in the arrow-F direction. This state is maintained so long as development lever 36 is not handled.

In FIG. 13, toner replenishment door 32 is fully opened, and development unit 30 is demounted. In this state, development lever 36 is brought to a nearly vertical position, hook 100 is disengaged from latch arm 98 of toner replenishment door 32, and development-pressing pin 30*a* is also disengaged from pressing arm 106 not to press development unit 30. Thus, protrusion 94*a* of stopper 94, in FIG. 11, fits to groove 92*b* and is locked by ridge 92*c,* and hook 100 and development lever 36 are energized by pulling coil spring 102 to turn around lever shaft 90 in the arrow-F direction. This state is maintained so long as development lever is not handled.

Starting from the state of FIG. 13, development pressing pin 30*a* is brought into contact with stopping face 106*c* of pressing arm 106 by pushing development unit 30 into the interior of copying machine 10. In the state of FIG. 14, similarly as in FIG. 13, protrusion 94*a* of stopper 94 is fit to groove 92*b* to be locked by ridge 92*c,* and the pressing arm can be moved only by handling of development lever 36, whereby pushed development unit 30 is stopped once in a state of FIG. 14. The position of development sleeve 60 as shown in FIG. 14 is an example of the position apart from photosensitive drum 56 (image-holding member) at a distance larger than the prescribed spacing.

Toner replenishment door 32 in the state shown in FIG. 14 cannot be closed, since hook 100 cannot catch latch arm 98 of toner replenishment door 32 and bottom end 100*c* of hook 100 stops the toner replenishment door 32 as shown in FIG. 15. Thus, when the development unit 30 is once stopped not to approach photosensitive drum 56 with the prescribed spacing, the toner replenishment door will not be closed. Thereby, the development sleeve is prevented from approaching photosensitive drum 56 with the prescribed spacing.

Starting from the state shown in FIG. 14, development sleeve 60 is brought near to photosensitive drum 56 to obtain the prescribed spacing by turning development lever 36 to the pressing position shown in FIG. 12 to press development pressing pin 30*a* by pressing face 106*b* of pressing arm 106. Thereby development sleeve 60 is brought near with the prescribed spacing to photosensitive drum 56, and the toner replenishment door 32 is completely closed as shown in FIG. 12. In this example, the stopping member of the present invention is constituted of hook 100, pulling coil spring 102, connecting arm 104, pressing arm 106, and development-pressing pin 30*a.*

INDUSTRIAL USEFULNESS

As described above, in the image formation apparatus of the present invention, in incorporation of the development unit into the main body of the image formation apparatus, the development unit is once stopped at a stopping position at a distance larger than the prescribed spacing from the image-holding member to prevent collision of development sleeve against the image-holding member. The once stopped development sleeve is moved to the prescribed position by turning the stopping member at a prescribed angle.

In this constitution, careless operation of turning the stopping member can be prevented by providing a development lever shaft having a stopping member fixed thereto and turning with the stopping member, as well as a turn-regulating member for regulating the turning of the development lever shaft.

Further, the development sleeve can be surely placed at the prescribed position by providing a door covering the development unit which can be opened and closed only when the development sleeve is brought to the prescribed position by turning the stopping member at a prescribed angle.

What is claimed is:

1. An image formation apparatus comprising an image-holding member rotating in a prescribed direction for forming an electrostatic latent image thereon; and a development unit having a development sleeve rotating at a prescribed position apart with a prescribed spacing from the image-holding member, and being demountably incorporated into the apparatus body; and developing the electrostatic latent image formed on the image-holding member and transferring the developed image onto an image-receiving medium:

said image formation apparatus having a development lever which is turnable in a predetermined direction when pushed in a direction perpendicular approximately to the direction of incorporating and demounting the development unit; and a stopping member which stops, during operation of incorporation of the development unit into the apparatus body, once the development sleeve apart from the image-holding member before the prescribed position, and then moves the once stopped development sleeve to the aforementioned prescribed position by pushing the aforementioned development lever in the above perpendicular direction and turning the development lever by a prescribed angle.

2. The image formation apparatus according to claim 1, wherein the apparatus has:

a development lever shaft which has the development lever and the stopping member fixed thereto and turning together with the development lever and the stopping member, a supporting plate which supports the development lever shaft and has two grooves with interposition of a ridge, and a protrusion which is made to fit to one of the above two grooves by pushing the aforementioned development lever in the above perpendicular direction and turning the development lever by a prescribed angle; and the development sleeve is placed at the predetermined position when the protrusion is fitted to one of the two grooves, and is placed at the position apart from the image-holding member before the prescribed position when the protrusion is fitted to the other one of the two grooves.

3. The image formation apparatus according to claim 1, wherein the image formation apparatus has a door which covers the development unit and is openable only when the stopping member is turned by the aforementioned prescribed angle to bring the development sleeve to the prescribed position, and a hook which catches the door only when the door is closed.

4. The image formation apparatus according to claim 2, wherein the image formation apparatus has a door which covers the development unit and is openable only when the stopping member is turned by the aforementioned prescribed angle to bring the development sleeve to the prescribed position, and a hook which catches the door only when the door is closed.

* * * * *